United States Patent [19]

Henry et al.

[11] Patent Number: 4,766,876

[45] Date of Patent: Aug. 30, 1988

[54] WOOD STOVE

[75] Inventors: Daniel S. Henry; G. Michael Hoteling, both of Colville, Wash.

[73] Assignee: Aladdin Steel Products, Inc., Colville, Wash.

[21] Appl. No.: 77,227

[22] Filed: Jul. 24, 1987

[51] Int. Cl.[4] ..... F24C 1/14

[52] U.S. Cl. ..... 126/77; 126/60; 126/83; 126/193; 126/290

[58] Field of Search ..... 126/60, 290, 61, 146, 126/64, 77, 297, 66, 83, 75, 76, 200, 193, 198, 112; 110/214, 210; 237/50, 52

[56] References Cited

U.S. PATENT DOCUMENTS

| | | | |
|---|---|---|---|
| 4,141,336 | 2/1979 | Fitch | 126/77 |
| 4,432,335 | 2/1984 | Kilham | 126/77 |
| 4,611,572 | 9/1986 | Martenson | 126/77 |
| 4,643,165 | 2/1987 | Chamberlain | 126/77 |
| 4,672,946 | 6/1987 | Craver | 126/77 |

*Primary Examiner*—James C. Yeung

*Attorney, Agent, or Firm*—Wells, St. John & Roberts

[57] ABSTRACT

A wood stove is described having a firebox with a baffle mounted therein that extends forward from a rear wall terminating in a forward edge spaced from a front wall. The wood stove has a front opening with a door thereon that includes a window enabling visual observation of the fire in the fuel combustion chamber. Air is emitted into the front wall and is directed downward in a thin laminar flow over the glass to wash the glass and to create a flow of air and gases downward along the front wall, rearward along the bottom wall, upward along the back wall and forward along the baffle in somewhat of a circular flow. The firebox is mounted on a pedestal with a primary air supply means drawing air through the hollow pedestal to an intake within the hollow pedestal for directing air through a channel to the back wall. The back wall includes a diffuser plate for directing air into the fuel combustion chamber to wash the fuel from the rear to assist in primary combustion. Air is additionally emitted into the fuel combustion chamber through an air intake manifold that is mounted in the fuel combustion chamber rearward and upward from a transverse center line for providing air to the upburned hydrocarbon gases emitted from the fuel to burn such gases within the fuel combustion chamber. The baffle is insulated to minimize the loss of heat from the chamber through the baffle and to maintain the heat level within the chamber at a high level to support efficient combustion. The several air inlets to the combustion chamber enable the wood stove to operate very efficiently over the full range of heat burning settings to provide efficient burning while minimizing the exhaust of pollutants.

21 Claims, 6 Drawing Sheets

WOOD STOVE

TECHNICAL FIELD

This invention relates to wood stoves.

BACKGROUND OF THE INVENTION

Many wood stoves claim that they have a high burning efficiency or are capable of heating large spaces or are able to burn "over night" without refueling or reloading. It is relatively easy to design a wood stove that is capable of efficient operation at a particular burning setting. However, it is very difficult to design a stove that is capable of very efficient burning characteristics over the full range of burning rates from high, medium and slow. Furthermore, it is difficult toprovide a wood stove that is not only efficient over the entire burning range, but that the emissions of smoke and hydrocarbon material including particulate material meet the Environmental Protection Agency requirements. To meet the Environmental Protection Agency requirements and other state agency requirements such as those of the State of Oregon and Colorado, many stove manufacturers have included a catalytic combustors that burn the exhaust to prevent the emission of particulate material. However, one of the problems with catalytic converters is that they deteriorate with time and require service after they have deteriorated to an inefficient state.

One of the objectives of the applicants' invention is to provide a very efficient wood stove that does not require a catalytic converter and is capable of efficiently burning the fuel over the full range of burning rate settings while minimizing the release of pollutants.

A further object of the applicant's invention is to increase the efficiency of burning to obtain maximum heat per pound of fuel wood while having very low emission rates which minimizes creosote build-up within the chimney or exhaust system.

A further object of this invention is to provide a very attractive wood stove that would be acceptable in one's living room as a piece of furniture while still maintaining a very efficient unit that is very efficient over a full range of heat output settings.

Other objects and advantages of this invention will become apparent upon reading the following detailed description of a preferred embodiment.

BRIEF DESCRIPTION OF THE DRAWINGS

The preferred and alternate embodiment of the invention is illustrated in the accompanying drawings, in which.

DETAILED DESCRIPTION OF THE PREFERRED AND ALTERNATE EMBODIMENT

The following disclosure of the invention is submitted in compliance with the constitutional purpose of the Patent Laws to promote the progress of science and useful arts" (Article 1, Section 8).

Figure 1:
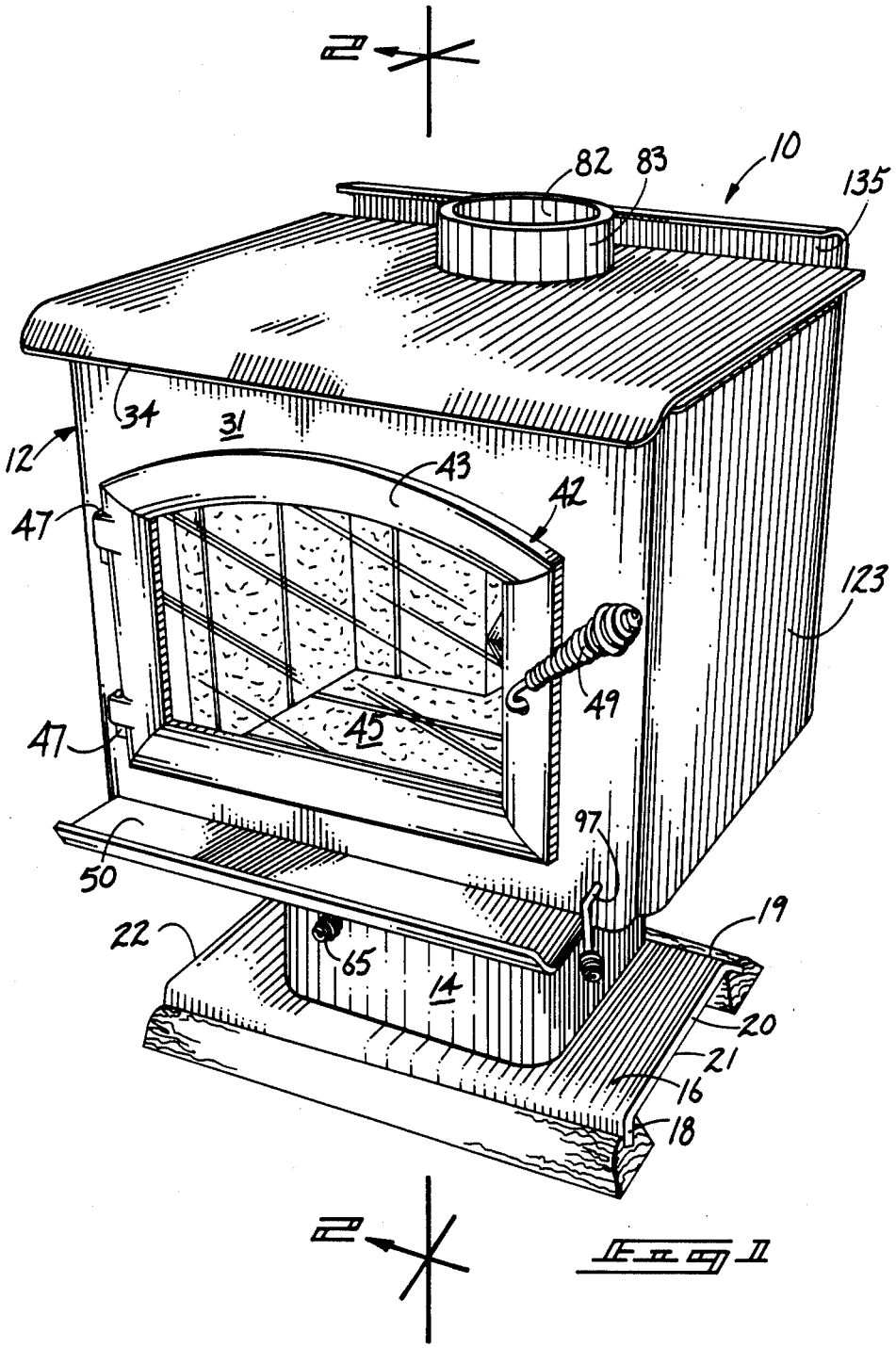
FIG. 1 is a perspective view of a preferred embodiment of the applicant's wood stove.

In referring now to the drawings, there is illustrated in FIG. 1 a wood stove generally designated with the numeral 10 for efficiently burning wood and generating heat for a living space in a very efficient manner emitting very few pollutants. The wood stove includes a firebox illustrated in FIGS. 2 and 3 that is mounted on a pedestal 14. The pedestal 14 has a pedestal base 16.

The pedestal base 16 includes a front flange or leg 18, a rear flange or leg 19 and a elevated central support section 20 forming apertures 21, 22 for admitting air into the stove at the base of the pedestal. The apertures 21, 22 form an air intake for primary air combustion. As illustrated in more detail in FIGS. 2 and 3, the pedestal includes side walls 24 constituting a conduit for the air intake to direct air from the bottom of the pedestal upward to the firebox 12. The pedestal 14 provides a very large air chamber that is preheated as the stove warms up to admit preheated air into the wood stove for primary fuel combustion.

Figure 2:
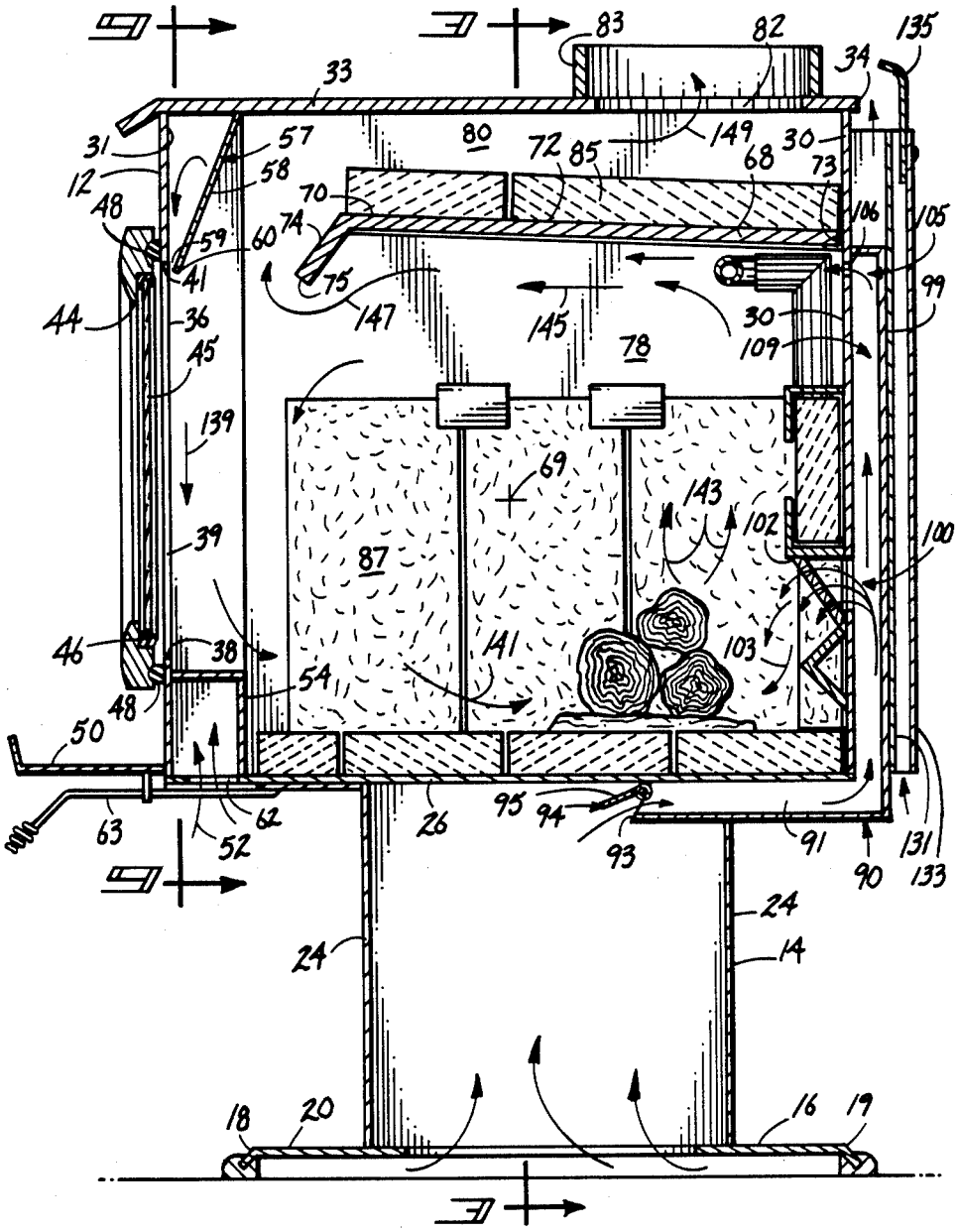
FIG. 2 is a vertical cross-sectional view taken along line 2—2 in FIG. 1 showing the interior of the wood stove particularly the fuel combustion chamber
Figure 3:
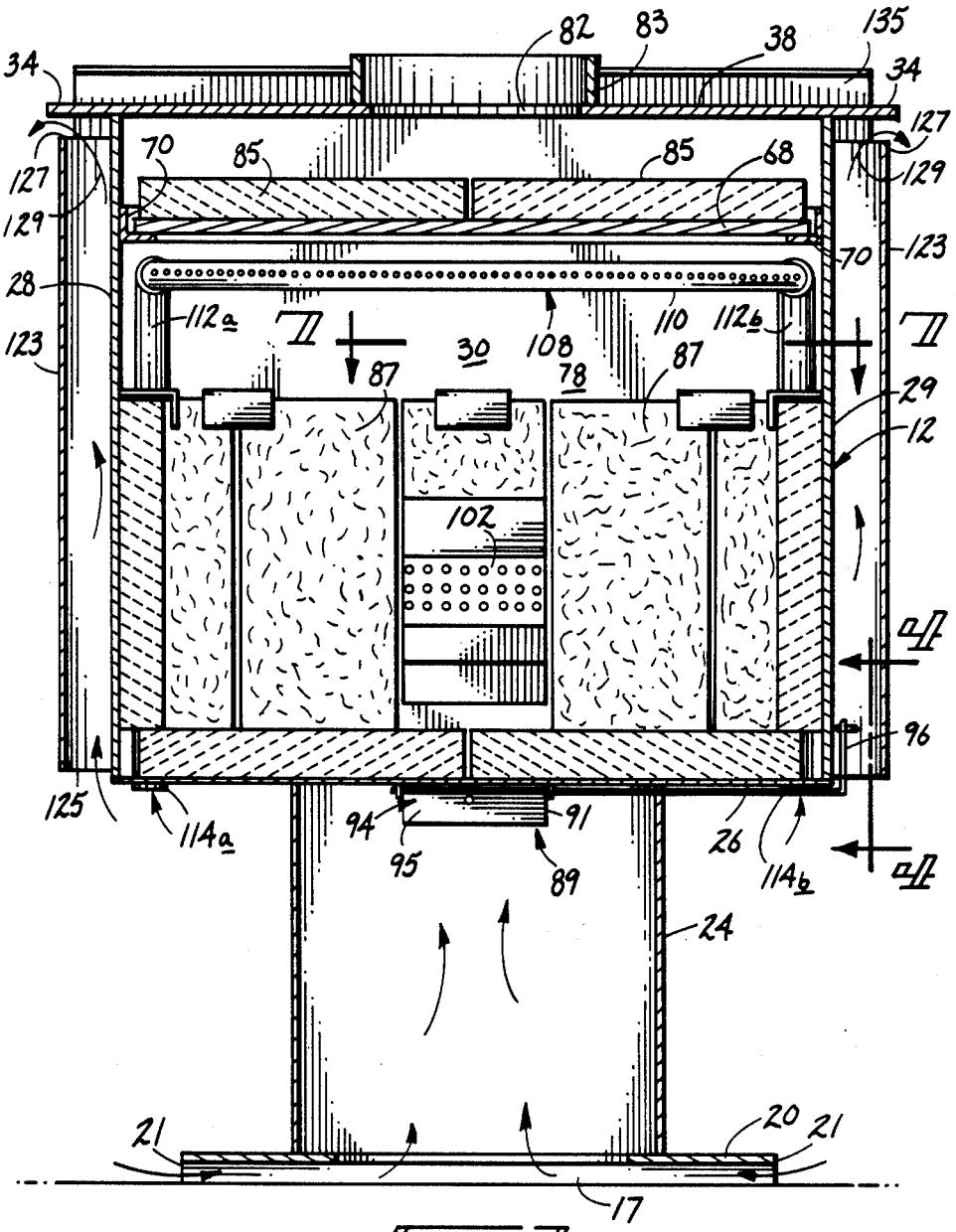
FIG. 3 is a cross-sectional view taken along line 3—3 in FIG. 2.

The firebox 12 includes a base or bottom wall 26 that is supported on the top of the pedestal 14. In turn, the base wall or plate 26 supports opposing side walls 28 and 29 and opposing rear wall 30 and front wall 31. A top wall or plate 33 is secured to the top edges of the side walls 28 and 29 and rear wall 30 and front wall 31 as illustrated in FIGS. 2 and 3 to enclose the firebox. The top wall or plate 33 has a peripheral edge 34 that extends beyond the side wall 28 and 29, the rear wall 30 and the front wall 31 as illustrated in FIGS. 2 and 3.

The front wall 31 has a fuel loading or entrance opening 36 formed therein in which the opening 36 has a bottom edge 38, side edges 39 and an upper convex curved edge 41.

The firebox 12 further includes a front door 42 that is mounted on the front wall 31 in which the door 42 has a substantially rectangular door frame 43 with a door aperture 44 formed therein to receive a glazed glass or window 45. The glass 45 enables the interior of the firebox to be observed while the door is closed to give the wood stove a firebox "look" and "feel". The glass 45 is held in the door frame by a resilient seal 46. The front door 42 is pivotally supported on the front plate 31 through hinges 47 (FIG. 1). The front door 42 has a door seal 48 extending about the door frame 43 for engaging the front wall 31 about the fuel loading opening 36 to provide an airtight seal when the door is closed. The front door 42 has a handle 49 that is pivotal to an open position in which wood may be loaded through the fuel loading opening 36.

The front wall 31 includes a front apron or hearth 50 illustrated in FIGS. 1 and 2 that extends forward of the front wall beneath the door 42 for preventing material such as ash from dropping directly onto the floor. Furthermore, the apron 50 provides a design feature that gives the stove a more balanced aesthetic appearance.

Figure 5:
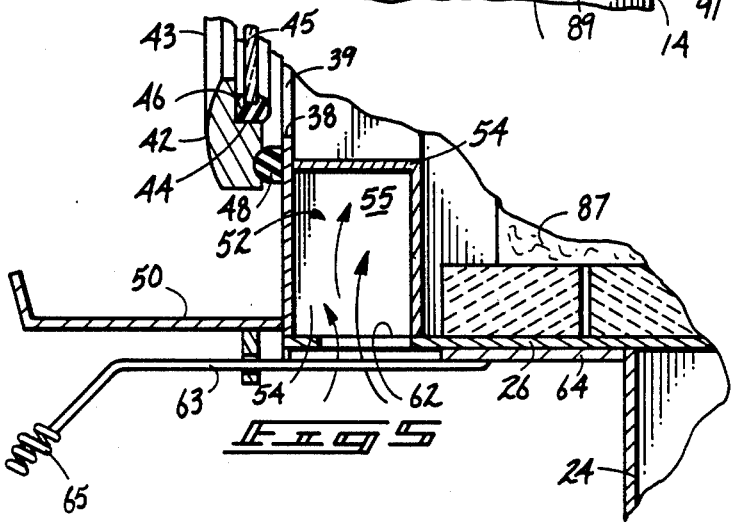
FIG. 5 is a enlarged fragmentary view of a potion of a front wall of the wood stove illustrating the operation of a secondary damper system with respect to a secondary air supply.
Figure 6:
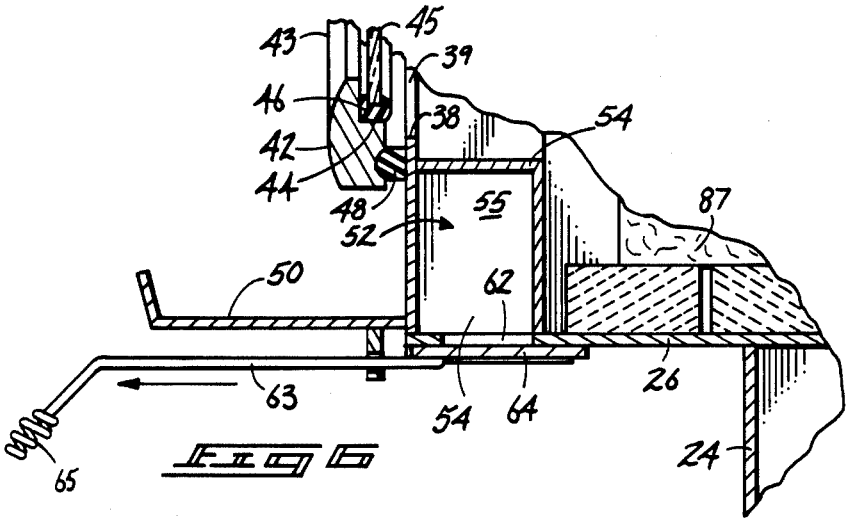
FIG. 6 is a figure similar to FIG. 5 except showing the damper closed to prevent air from being admitted to the second air supply.
Figure 7:
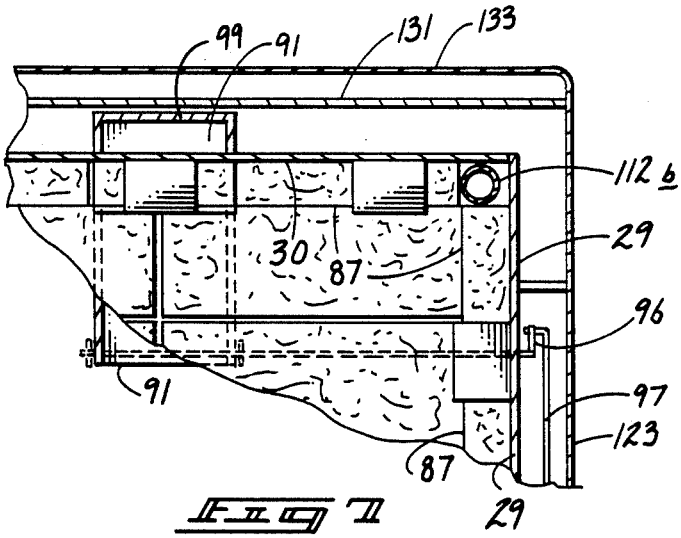
FIG. 7 is a fragmentary cross-sectional view taken along line 7—7 in FIG. 3 illustrating in plan view two separate air supplies for admitting air into the fuel combustion chamber.

The wood stove 10 has a secondary combustion air supply means 52 associated with the front wall for supplying air into the interior of the firebox 12. The air supply means 52 includes a bottom channel 54 affixed to the front wall and the bottom wall as illustrated in FIGS. 2, 5 and 6. Side channels 55 and 56 are mounted in the front corners between the front wall and the side walls for providing air conduits along the front side corners of the firebox that extend upward to a distributor 57 that extends horizontally over the front fuel loading opening 36 for distributing preheated air in a thin laminar current downward over the inside of the glass or window 45 for washing the window and to keep the window clear.

The distributor 57 includes a bowed plate 58 that is mounted between the side channels 55 and 56 horizontally above the fuel loading opening in which the bowed plate forms a long, narrow slot or opening 59 between the front wall 31 and the bowed plate 58. The opening is preferably one sixteenth of an inch in thickness and extends at least a total distance between the side edges 40 of the fuel loading opening 36. The bowed plate 58 terminates in a terminal edge 60 which is convex and is complementary in curvature to the top curved edge 41 of the opening 36. It should be noted that the terminal edge 60 extends downward a slight distance below the complementary top curved edge 41 of the opening. The bowed plate 58 provides a distributor 57 in which the air is progressively formed and directed in a thin laminar flow downward along the inside of the window 45. The air as it passes through the bottom channel 58, the side channels 55 and 56 and the distributor 57 is heated so that the air is preheated before it is emitted into the interior of the firebox. The air supply means 52 further includes an intake opening 62 formed in the bottom channel 54 preferably midway between the side channels 55 and 56. The air supply means 52 includes a damper or air control or regulator 63 to vary the effective intake opening to adjust the amount of air passing through the distributor 57. The damper 63 includes a damper plate 64 that is mounted for slidable movement as illustrated in FIGS. 5 and 6. The damper plate 64 is attached to a damper handle 65 that extends forward of the front wall 31. When the handle is pushed forward as illustrated in FIG. 5, maximum air is emitted into the bottom channel 54. When the damper handle 65 is pulled full back, the intake opening is closed so that no air is admitted. Thus, the damper 63 provides for a substantially infinitely variable adjustment of the preheated air that is emitted in a laminar flow along the inside of door glas 45.

The firebox 12 further includes an internal baffle 68 that is mounted within the firebox intermediate the base wall 26 and the top wall 33 and specifically above a center transverse axis 69 of the interior chamber of the firebox (FIG. 2). The baffle 68 is mounted on baffle brackets 70 there affixed to the side walls 28, 29 and the rear wall 30.

The baffle 68 extends entirely across the interior of the firebox between the side walls 28 and 29 and has a main section 72 with a rear edge 73 engaging the baffle brackets 70 along the rear wall. The main section extends forward and upward at a slight incline as illustrated in FIG. 2 well past the center axis 69. The main section 72 terminates in a forward section or lip 74 that extends downward and forward at a rather sharp incline terminating in a forward edge 75. It should be noted that the forward edge 75 extends downward to an elevation lower than the rear edge 73 and in addition lower than the opening edge 60 of the distributor throat 57.

The baffle 68 defines a fuel combustion chamber 78 between the baffle and the base wall 26 and an exhaust heat exchanger chamber 80 between the baffle 68 and the top wall 33. The top wall 33 has an exhaust outlet 82 formed therein communicating with the exhaust chamber 80. A stove pipe fitting 83 surrounds the exhaust outlet 82 for connecting to a stove pipe or outlet conduit.

Baffle 68 includes baffle insulation and heat absorber 85 on the baffle 68 or forming as part thereof for insulating the baffle to minimize the transfer of heat from the fuel combustion chamber 78 through the baffle and to hold the heat in the combustion chamber. Additionally the baffle insulation serves as a heat absorber to maintain the temperature in the fuel combustion chamber as high as reasonably possible to obtain maximum efficiency. Preferably the baffle insulation 85 is composed of fire brick that is mounted on an upper surface of the baffle as illustrated in FIG. 2. Liner fire bricks 87 are mounted on the side walls and base walls 28, 29 and 26 to protect such walls and to provide heat storage or a heat sink to store heat and to maintain the temperature within the fire combustion chamber 78 as high as possible for maximum efficiency.

Figure 4:
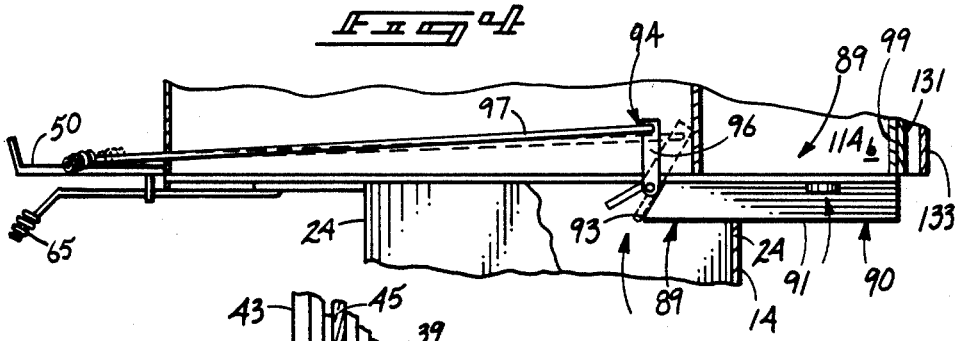
FIG. 4 is a fragmentary detail view taken along line 4—4 in FIG. 3, illustrating a damper system for a primary air supply.

The stove 10 further includes a primary combustion air supply means 89 for providing air for primary combustion of the wood fuel. The air supply means 89 includes a U-shaped channel 90 that is affixed centrally to the bottom wall 26 and the back or rear wall 30. The U-shaped channel 90 has an inlet section 91 within the interior of the pedestal 14 as illustrated in FIG. 2. The inlet section 91 is mounted midway between the side walls 28 and 29 and has an opening 93 into the central portion of the pedestal 14. A damper 94 is mounted at the opening 93 in which the damper is adjustable to selectively adjust the amount of air that is emitted into the fuel combustion chamber 78 through the opening 93. The damper 94 includes a damper plate 95 with a damper linkage 96 extending laterally connecting to a damper handle 97 shown in more detail in FIG. 4. The U-shaped channel 90 has a back section 99 communicating with the inlet section 91 and extends upward along the back wall 30 terminating just short of the baffle 68 as illustrated in FIG. 2. The air supply means 89 includes a back wall opening 100 formed in the back wall below the central transverse axis 69 illustrated in FIG. 2. The opening 100 has an air diffuser 102 mounted therein that is mounted at an inclined angle to direct air into the fuel combustion chamber 78 with the air flow path 103 directed forward and downward to impinge the fuel from the rear. The air path 103 mainly supports primary combustion of the fuel. The air supply means 52 supports secondary combustion of the fuel from the front.

The stove 10 further includes an air supply means 105 formed in the upper portion of the back section 99 with apertures 106 formed in the back wall 31 immediately below the baffle 68 for directing preheated air into the fuel combustion chamber 78 immediately below the baffle 68 to assist in supporting combustion of unburned hydrocarbon gases that are emitted from the fuel. Such combustion of unburned combustion gases is generally referred to as "secondary combustion." The damper 94 additionally controls the flow of air associated with the air supply means 105 and through the apertures 106.

Figure 8:
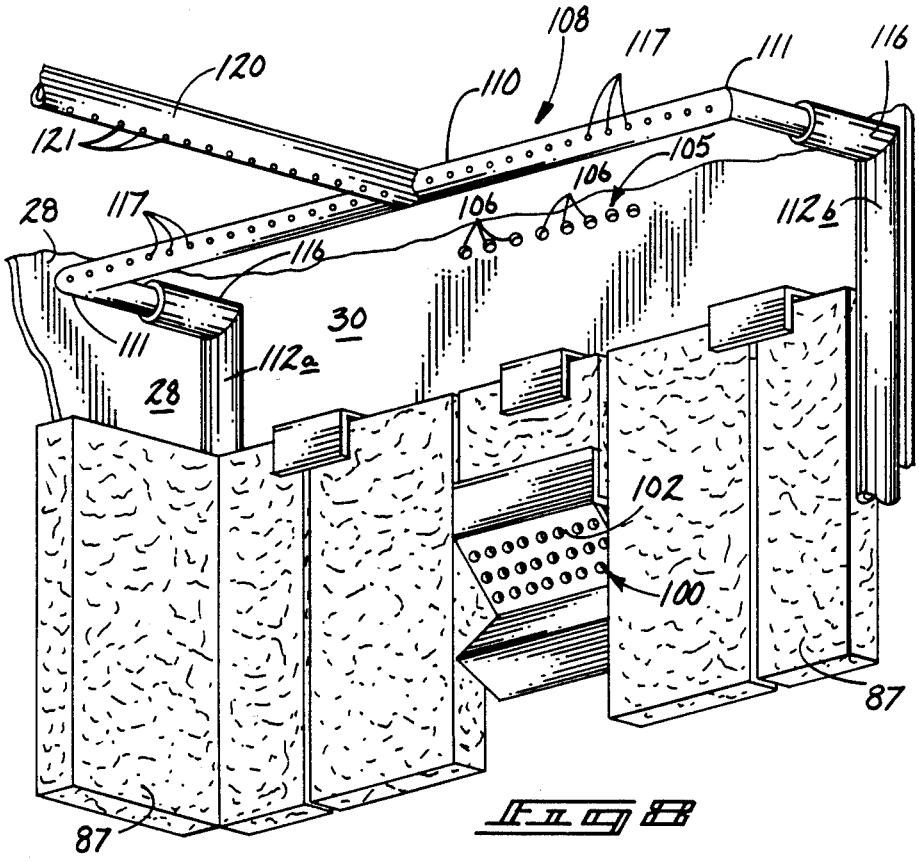
FIG. 8 is a perspective view of the portion of the interior of the fuel combustion chamber emphasizing a manifold system for injecting air into the fuel combustion chamber.
Figure 9:
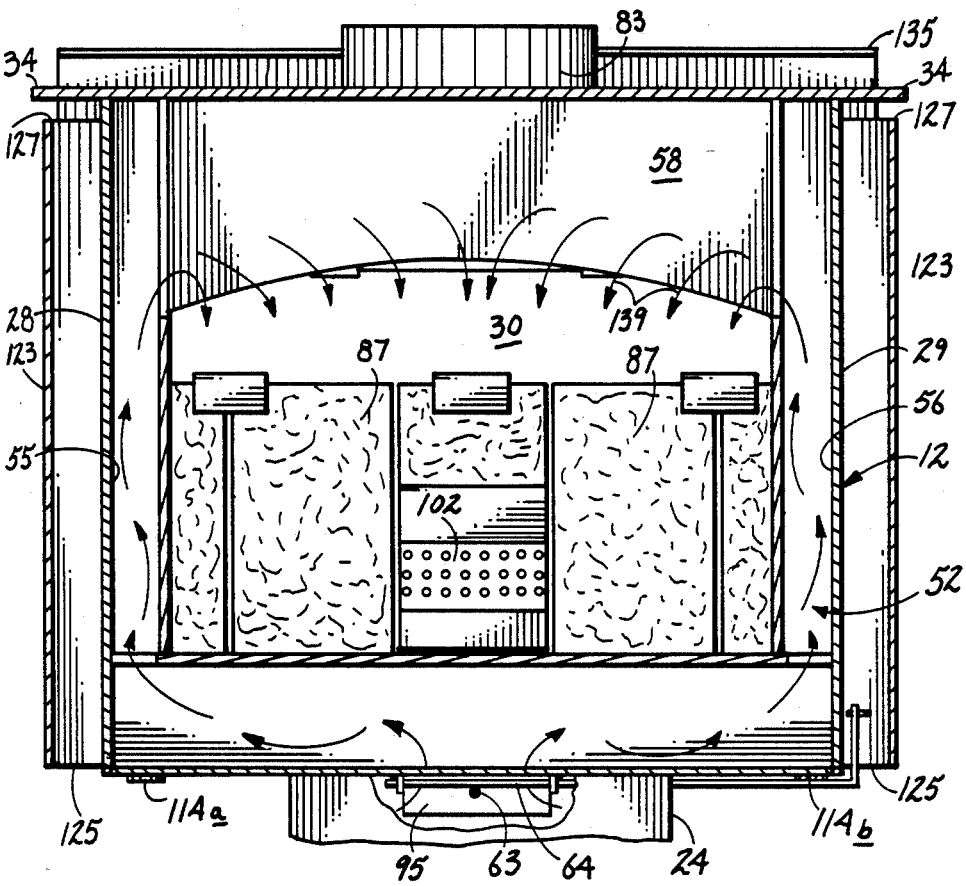
FIG. 9 is a vertical cross-sectional view taken along line 9—9 in FIG. 2 illustrating the construction of the front wall of the wood stove.
Figure 10:
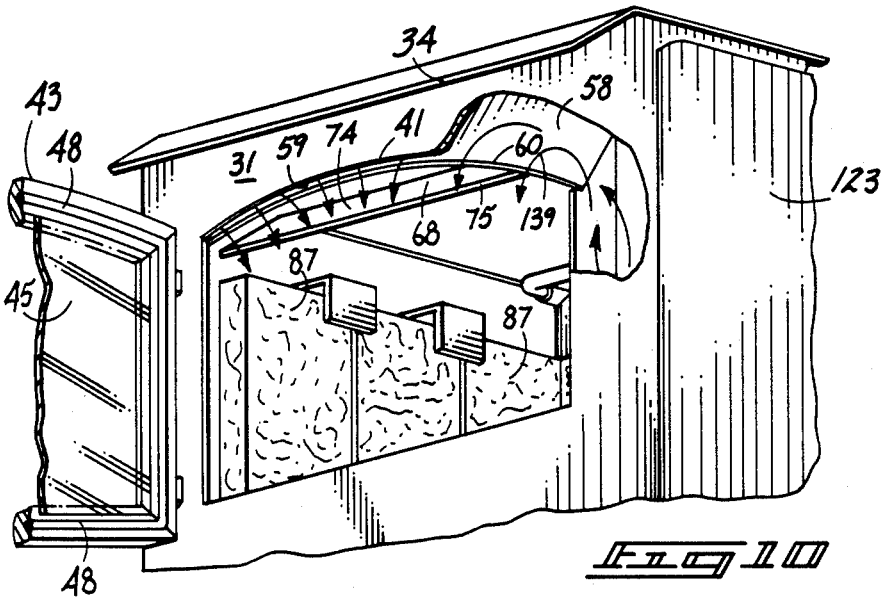
FIG. 10 is a perspective view of a portion of a front wall with the stove door open.

The stove 10 further includes a secondary combustion air supply means 108 (FIG. 8) that preferably includes an air injection manifold 110 that is mounted within the fuel combustion chamber 78 immediately below the baffle 68 and immediately forward of the apertures 106 for directing a supply of super heated air into the fuel combustion chamber to support combustion of unburned hydrocarbon gases emitted from the fuel. The fuel injection manifold 110 extends transversely across a substantial portion of the fuel combustion chamber 78 between the side walls 28 and 29. The manifold 110 has terminating curved ends 111. The secondary combustion air supply means 108 further includes air supply conduits 112*a* and 112*b* that extend upward through the base wall 28 as illustrated in FIGS. 2, 3 and 8. The supply conduits 112*a* and 112*b* have inlets 114*a* and 114*b* that extend thruogh the base plate 26 adjacent the rear corners of the firebox and are exposed to the outside for drawing air through the inlets and up the supply conduits 112*a* and 112*b* to the air injection manifold 110. The supply conduits 112*a* and 112*b* have curved ends 116 for receiving the ends 111 of the air injection manifold 110 as illustrated in FIG. 8. A series of injection orifices 117 are formed in the manifold at spaced intervals. The orifices 117 have very small diameters and are evenly spaced along the manifold for directing super heated air forward into the fuel combustion chamber 78 immediately below the baffle 68 to support combustion of the unburned hydrocarbon gases.

In an alternate embodiment illustrated in FIG. 8, the air injection manifold 110 additionally includes a manifold projection 120 so that the manifold is "T" shaped in which the projection 120 has a series of apertures 121 formed therein along the length of the projection 120 for directing additional super heated air downward into the combustion chamber. The manifold projection 120 extends forward beyond the transverse center axis 69.

The wood stove 10 further includes convection side panels 123 that are mounted to and spaced from the side walls 28 and 29. The panels 123 extend from lower edges 125 that are located at approximately the same level as the bottom plate or wall 26 and extend upward to top edges 127 that are spaced slightly below the top wall 33 forming an exit gap 129. Convection air enters between the convection side panels 123 at the lower edge 125 and ascends substantially vertically between the panels 123 and the side walls 28 and 29 with the air being heated by conduction and passing through the gap 129 to heat the living space by convection.

In conjunction with the side convection panels 123, the wood stove 10 has an inside convection back panel 131 affixed to and spaced from the rear wall 30. The rear wall 30 has a second outside convection back panel 133 mounted to and spaced from the inside convection back panel 131 to provide additional air spacing and room for convection gases to flow therebetween to transfer the heat from the stove and particularly the back wall to the living area while keeping the back wall and panels relatively cool to prevent ignition of material near the stove. The convection side panels 123 and the convection back panels 131 and 133 protect a person from being severely burnt should the person accidentally touch the panels. A back panel deflector 135 is mounted to the upper edge of the outside convection back panel 133 as illustrated in FIG. 2 for deflecting the convection air forward over the top wall 33.

During the operation of the wood stove 10, the dampers 63 and 94 are moved to a full open position to admit maximum air into the fuel combustion chamber. The fuel is then ignited and the door is closed with air from the air supply means 52 passing through the intake opening 62 in the front wall and passing through the channels 54, 55, 66 and through the distributor 57 with the distributor 57 directing the air down through the long, narrow slot in a laminar flow or path 139. At least a portion of the air then passes in a rearward path 141 to impinge the forward part of the fuel. At the same time, air supply means 89 provides primary combustion air as indicated by the flow path 103 illustrated in FIG. 2. It should be noted that air passing through the distributor 57 and through the air diffuser 102 is preheated as the stove heats up. The air from the flow 141 and the flow 103 provides a primary combustion of the fuel with the hot gases containing both burned and unburned hydrocarbons ascending in an upward exhaust path identified by numeral 143 in FIG. 2. As the gases reach the baffle 68, they are directed forward in a forward exhaust path 145. In the forward exhaust path 145, preheated air through the air flow supply means 105 and the apertures 106 is provided to support secondary combustion of the unburned gases in the air flow 145. Additionally and even more importantly, a secondary combustion air is provided through the air injection manifold 111 that directs super heated air forward in the flow 145 to support a vigorous secondary combustion of the unburned gases that are emitted from the fuel. As the burned exhaust gases move forward under the baffle 145, a portion of the gases is recirculated in a counterclockwise circular flow as shown in FIG. 2. Another portion of the gases move in a reverse exhaust path 147 around the forward edge 75 of the baffle 68 and into the exhaust chamber 80. From the exhaust chamber 80, the gases flow rearward and then upward through the exit in a path identified as 149. The insulated baffle 68 is a substantial heat sink and maintains the heat in the combustion chamber 78 in conjunction with the lined fire brick 87 to keep the combustion chamber as hot as possible. The fresh air that has been preheated through the air flow supply means 105 and the secondary combustion air supply means 108 provides fresh preheated air along the bottom of the baffle 68.

After the fire in the fuel combustion chamber 78 heats the stove and begins emitting heat to the living space by the convection flow that passes between the walls and the panels, the operator may desire to reduce the amount of air emitted into the combustion chamber through the air supply means 89 to reduce the amount of primary combustion to reduce the burning rate of the fuel. A medium burning rate can be supported even with the damper 94 closed so that there is no fresh air emitted in the path 103 to the fuel but the entire fresh air is provided through the air supply means 52 in the front wall and through the air injection manifold 110.

If it is desired to burn the fuel at a low burning rate, then the damper 63 in the front wall is partially closed to minimize the entry of oxygen in the flow paths 139 and 141. Even at a low burning rate, air is still supplied through the air injection manifold 110 to support combustion of the unburned gases. At a low burning rate, it is not unusual to see no flame emanating from the fuel, but see a blue flame dancing along the underside of the baffle 68, caused by the burning of the unburned hydrocarbon gases emitted from the fuel.

With the applicant's stove, a very efficient burning of the fuel is accomplished over the full range of the burning rates whether from very high to very low and that the amount of smoke or particulate material emitted from the stove is very low and well below values subscribed to by government regulation.

It should be further noted that the applicant's wood stove preheats all of the air that enters the combustion chamber with the air that is emitted through the air injection manifold 110 being superheated before being injected into the fuel combustion chamber. As further noted, because of the insulation of the baffle and partially because of the heat storage capability of the lined fire brick, the fuel combustion chamber 78 is maintained very hot to support combustion and to increase the efficiency of the burning. It is further noted that the heated air in air supply means 52 is directed through the distributor 57 through the long narrow slot 59 to provide a laminar flow along the window 45 to keep the glass clean and to provide an even flow of the heated oxygen into the combustion chamber and provide the counterclockwise movement of the gases within the combustion chamber as illustrated in FIG. 2.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A wood stove, comprising:

a firebox enclosure having a base wall, a top wall, a front wall with a fuel entry opening formed therein, a rear wall and side walls extending between the base wall and the top wall;

a front entry door mounted on the front wall for enabling wood fuel to be loaded through the fuel entry opening when the door is open and for covering the fuel entry opening when the door is closed;

a baffle mounted in the enclosure between the side walls and intermediate the top and base wall and extending forward from the back wall terminating in a front edge spaced from the front wall dividing the interior of the enclosure into a lower fuel combustion chamber below the baffle and an upper exhaust heat-exchanging chamber above the baffle;

an exhaust opening formed through one of the walls and opening into the upper exhaust heat exchanging chamber;

a first air supply means having an opening in the rear wall for permitting the flow of air into the fuel combustion chamber to impinge the fuel from the rear to support primary combustion of the fuel;

a second air supply means for permitting flow of air into the fuel combustion chamber and for directing the air in a circular current path, first in a downward path along the inside of the front wall, second in a rearward path along the base wall to wash the fuel from the front to support combustion of the fuel, third in an upward exhaust path, fourth in a forward exhaust path along a lower surface of the baffle, and fifth in a path upward over the front edge of the baffle and rearward through the exhaust chamber to the exhaust opening;

a third air supply means having an air injection manifold positioned at an elevated position in the fuel combustion chamber immediately below the baffle for injecting air into the forward exhaust path to facilitate the burning of previously unburned hydrocarbon gases released from the fuel within the fuel combustion chamber; and said baffle having heat absorbing and insulating means thereon in heat exchanging relationship with lower combustion chamber and the upper exhaust heat exchanging chamber to minimize a loss of heat through the baffle and to maximize the burning temperature in the fuel combustion chamber.

2. The wood stove as defined in claim 1 wherein the front entry door has a window mounted therein to provide visual observation of the burning of the fuel and wherein the second air supply means directs the air in a thin laminar flow to wash downward across the window to shield the window and to keep the window clean.

3. The wood stove as defined in claim 1 wherein the front entry door has a window mounted therein and wherein the second air supply means includes (1) a bottom chamber mounted in the front wall below the fuel entry openign extending toward the side walls, (2) side channels formed in the front wall extending vertically from the bottom channel upward above the fuel entry opening, (3) an overhead air wash distributor extending between the side channels above the fuel entry opening, (4) said distributor having a long narrow opening that extends across the front opening, (5) an adjustable air opening communicating with the bottom channel for admitting the air into the bottom channel that flows through the bottom chamber and the side channels to the distributor to preheat the air, and wherein the preheated air is directed in a downward path through the distributor and exits into the fuel combustion chamber in a laminar flow through the long narrow opening to wash the inside of the window as the air moves in the downward path.

4. The wood stove as defined in claim 3 wherein the fuel entry opening has an upper edge and wherein the long narrow opening of the distributor has a throat edge below the upper edge of the fuel entry opening to increase the directional efficiency of the air wash downward across the window.

5. The wood stove as defined in claim 4 wherein the upper edge of the fuel entry opening is curved in a substantially convex curve to increase the size of the fuel entry opening and wherein the throat edge of the distributor is bowed throat wall defining the air passage terminating in a complementary convex throat edge in which th width of the long narrow opening is substantially constant to provide a uniform laminar flow of air downward across the entire window.

6. The wood stove as defined in claim 1 wherein the first air supply means has a diffuser in the rear wall that directs the flow of air downward and forward to impinge the fuel from the rear.

7. The wood stove as defined in claim 1 further comprising a fourth air supply means having an opening in the rear wall immediately below the baffle for directing air forward into the forward exhaust path and around the air injection manifold to further facilitate the burning of previously unburned hydrocarbon gases within an upper portion of the fuel combustion chamber.

8. The wood stove as defined in claim 7 wherein the first and fourth air supply means have a common source and a common damper to regulate the amount of air admitted into the fuel combustion chamber through the rear wall.

9. The wood stove as defined in claim 1 wherein the third air supply means includes upright corner conduits that extend upward from the base wall at rear corners of the firebox adjacent the rear and side walls and wherein the corner conduits interconnect with the air injection manifold for preheating outside air and directing the preheated air into the air injection manifold.

10. The wood stove as defined in claim 9 wherein the air injection manifold is "T"-shaped with a center leg extending forward underneath the baffle.

11. The wood stove as defined in claim 1 wherein the base, rear and side walls have fire brick thereon to protect said walls and wherein fire brick is mounted on an upper side of the baffle to minimize the loss of heat through the baffle and to maximize the burning temperature in an upper portion of the fuel combustion chamber.

12. The wood stove as defined in claim 1 wherein the baffle is mounted within the firebox at an elevation above the front wall fuel entry opening and wherein the baffle has a forward lip that extends forward and downward terminating in a front edge to deflect the forward exhaust edge.

13. The wood stove as defined in claim 12 wherein the front edge of the lip is at an elevation below an upper edge of the front wall fuel entry opening.

14. The wood stove as defined in claim 1 wherein the baffle is mounted in firebox with (1) a rear section extending forward and upward at an incline from a rear edge, and (2) a front section extending forward and downward to the front edge in which the front edge is elevationally below the rear edge for defining the forward exhaust path.

15. The wood stove as defined in claim 1 wherein the first air supply means includes an air inlet below the opening in the rear wall.

16. The wood stove as defined in claim 15 wherein the first air supply means includes a damper with an air inlet for selectively regulating the flow of air through the inlet.

17. The wood stove as defined in claim 1 wherein the second air supply means includes a discharge opening over the fuel entry opening, and a secondary air supply inlet below the discharge opening.

18. The wood stove as defined in claim 17 wherein the third air supply means includes an intake opening below the air injection manifold.

19. The wood stove as defined in claim 1 wherein the first, second and third air supply means all include air intake openings situated below the fuel entry opening.

20. A wood stove, comprising:

a firebox enclosure having a base wall, a top wall, a rear wall and side walls extending between the base wall and top wall;

wherein one of the wall includes a fuel entry opening therein;

a baffle mounted substantially horizontally within the enclosure between the side walls and intermediate the top and base walls, dividing the firebox enclosure into a lower fuel combustion chamber and an upper heat exchanging and exhaust chamber, and including an edge spaced from one of the walls to define an open passageway between the fuel combustion chamber and the heat exchanging and exhaust chamber;

an exhaust outlet formed through one of the walls and opening into the heat exchanging and exhaust chamber;

heat absorbing means on the baffle for maximizing burning tempeatures within the fuel combustion chamber and in heat exchanging relationship with the lower fuel combustion chamber and upper heat exchanging chamber;

combustion air supply means for supplying combustion air to the fuel combustion chamber below the heat absorbing means, including a primary combustion air supply to support primary combustion of fuel adjacent the base wall, and to support secondary combustion of unburned fuel in the form of gases and hydrocarbons downwardly adjacent the heat absorbing means so that substantially all combustion occurs within the fuel combustion chamber thereby enabling the heat exchanging and exhaust chamber to receive burned gases and to effect maximum heat transfer from the burned gases to the surrounding areas of the firebox and to the heat absorbing means as the burned gases move over the heat absorbing means through the heat exchanging and exhaust chamber from the baffle edge to the exhaust outlet.

21. A wood stove, comprising:

a firebox enclosure having a base wall, a top wall, a front wall, a rear wall and side walls extending between the base wall and top wall;

wherein one of the wall includes a fuel entry opening therein;

a baffle mounted substantially horizontally within the enclosure between the side walls and intermediate the top and base walls, dividing the firebox enclosure into a lower fuel combustion chamber and an upper heat exchanging and exhaust chamber, and including an edge spaced from one of the walls to define an open passageway between the fuel combustion chamber and the heat exchanging and exhaust chamber;

an exhaust outlet formed through one of the walls and opening into the heat exchanging and exhaust chamber;

heat absorbing means on the baffle for maximizing burning temperatures within the fuel combustion chamber and in heat exchanging relationshp with the lower fuel combustion chamber and upper heat exchanging chamber;

combustion air supply means for supplying combustion air to the fuel combustion chamber below the heat absorbing means, including (a) a primary combustion air supply to support primary combustion of fuel adjacent the base wall, and (b) first secondary combustion air supply, (c) a second supply of secondary air separate from the first secondary combustion air supply and (d) third undampered secondary combustion air supply separate from the first and second supplies; wherein all three secondary combustion air supplies support secondary combustion of unburned fuel in the form of gases and hydrocarbons downwardly adjacent the heat absorbing means to transmit heat to the heat absorbing means and so that substantially all combustion occurs within the fuel combustion chamber thereby enabling the heat exchanging and exhaust chamber to receive burned gases and to effect maximum heat transfer from the burned gases to the surrounding areas of the firebox and heat absorbing means as the burned gases move over the heat absorbing means through the heat exchanging and exhaust chamber from the baffle edge to the exhaust outlet.

* * * * *